US009339120B2

(12) United States Patent
Speer

(10) Patent No.: US 9,339,120 B2
(45) Date of Patent: May 17, 2016

(54) BODILY SUPPORT ASSEMBLY

(71) Applicant: Miriam Speer, Jordan (CA)

(72) Inventor: Miriam Speer, Jordan (CA)

( * ) Notice: Subject to any disclaimer, the term of this patent is extended or adjusted under 35 U.S.C. 154(b) by 0 days.

(21) Appl. No.: 14/515,643

(22) Filed: Oct. 16, 2014

(65) Prior Publication Data

US 2016/0106229 A1 Apr. 21, 2016

(51) Int. Cl.

| | |
|---|---|
| ***A63H 33/00*** | (2006.01) |
| ***A47D 13/06*** | (2006.01) |
| ***A47D 1/00*** | (2006.01) |
| ***A47C 7/40*** | (2006.01) |

(52) U.S. Cl.

CPC . *A47D 13/06* (2013.01); *A47C 7/40* (2013.01); *A47D 1/00* (2013.01)

(58) Field of Classification Search

USPC ..... 446/227, 482; 434/258; 297/136, 137, 297/183.1, 183.3, 219.1, 219.12, 220, 221, 297/273, 274

See application file for complete search history.

(56) References Cited

U.S. PATENT DOCUMENTS

| | | | | |
|---|---|---|---|---|
| 4,695,092 | A | 9/1987 | Hittie | |
| 4,712,833 | A | 12/1987 | Swanson | |
| D294,210 | S | 2/1988 | Rhodes et al. | |
| 4,889,388 | A | 12/1989 | Hime | |
| 5,211,607 | A * | 5/1993 | Fermaglish | A47D 13/043 297/137 |
| 5,518,475 | A * | 5/1996 | Garland | A47D 13/043 482/66 |
| 5,728,030 | A * | 3/1998 | Hsieh | A47D 13/043 472/15 |
| 6,000,761 | A * | 12/1999 | Rocha | A47D 1/008 297/183.1 |
| D484,350 | S | 12/2003 | Miller | |
| 6,682,139 | B2 * | 1/2004 | Bellows | A47D 1/008 297/136 |
| 6,854,799 | B1 * | 2/2005 | Asbach | A47D 3/00 297/136 |
| 6,918,631 | B2 | 7/2005 | Verbovszky | |
| 7,523,984 | B2 * | 4/2009 | Steininger | A47D 1/008 280/87.05 |
| 7,806,471 | B2 | 10/2010 | Nishimoto | |
| 7,806,472 | B2 | 10/2010 | Runk et al. | |
| 8,104,780 | B1 * | 1/2012 | McConnell-Copploe | A47D 13/043 280/47.371 |
| 8,303,033 | B2 * | 11/2012 | Lundeen | A47D 3/00 297/136 |
| 8,308,239 | B2 * | 11/2012 | Lundeen | A47D 3/00 297/273 |
| 8,944,514 | B2 * | 2/2015 | Tadin | A47D 1/008 297/219.12 |
| 2002/0014793 | A1 | 2/2002 | Santha | |
| 2010/0078976 | A1 * | 4/2010 | Hou | B60N 2/2881 297/230.13 |

* cited by examiner

*Primary Examiner* — Kurt Fernstrom

(57) ABSTRACT

A bodily support assembly for securely holding an infant in a play station includes the play station structured to contain the infant. A first support is structured to be positioned within the play station. A second support is structured to be positioned around the infant. The second support is positioned within the first support. The infant is securely held within the play station. A head rest is structured to prevent backwards tipping of the infant's head while the infant is positioned within the play station.

11 Claims, 5 Drawing Sheets

BODILY SUPPORT ASSEMBLY

BACKGROUND OF THE DISCLOSURE

Field of the Disclosure

The disclosure relates to support devices and more particularly pertains to a new support device for securely holding an infant in a play station.

SUMMARY OF THE DISCLOSURE

An embodiment of the disclosure meets the needs presented above by generally comprising a play station structured to contain an infant. A first support is structured to be positioned within the play station. A second support is structured to be positioned around the infant. The second support is positioned within the first support. The infant is supported within the play station. A head rest is structured to support the infant's head while the infant is positioned within the play station.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
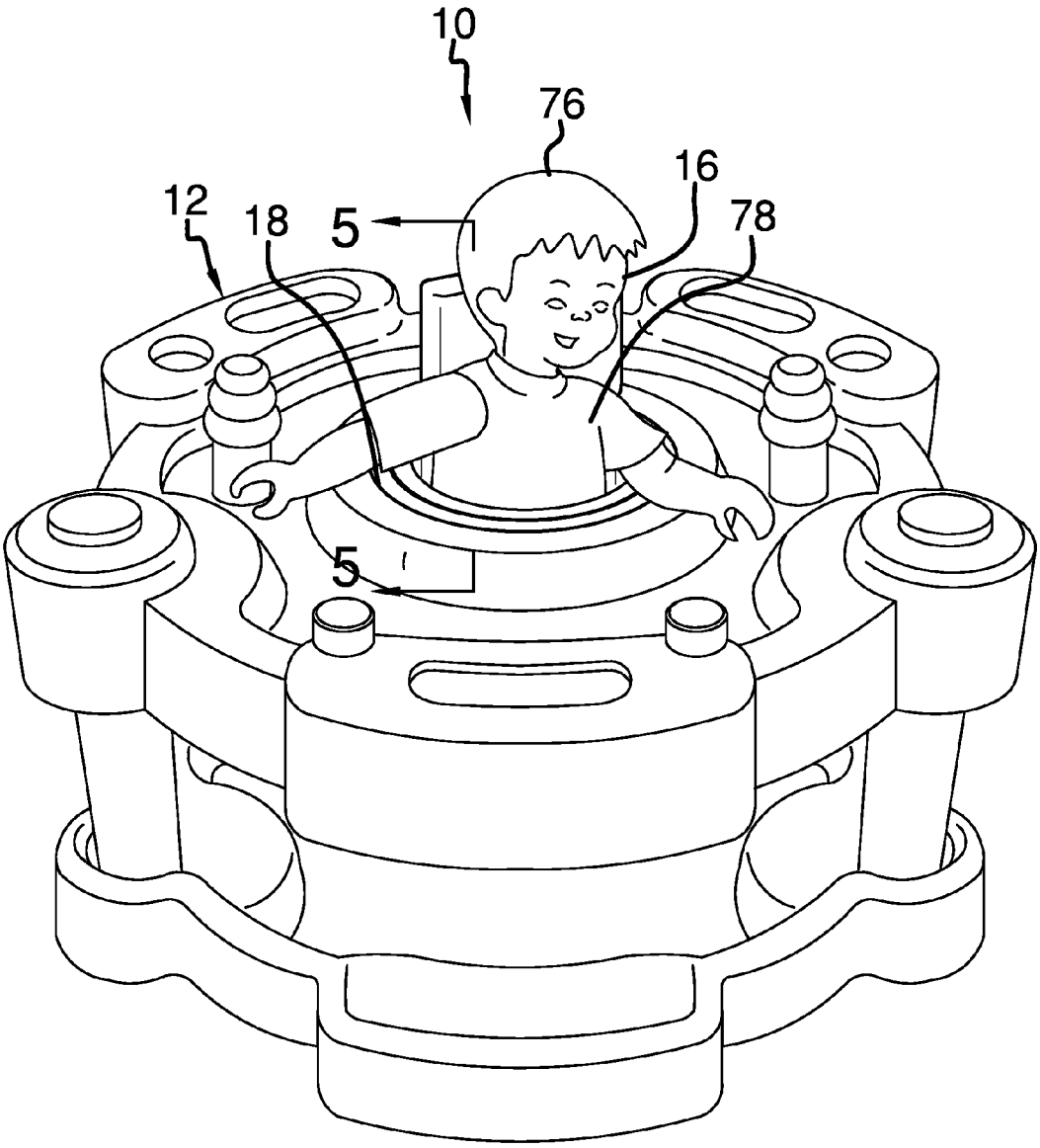
FIG. 1 is a perspective view of a bodily support assembly according to an embodiment of the disclosure.
Figure 2:
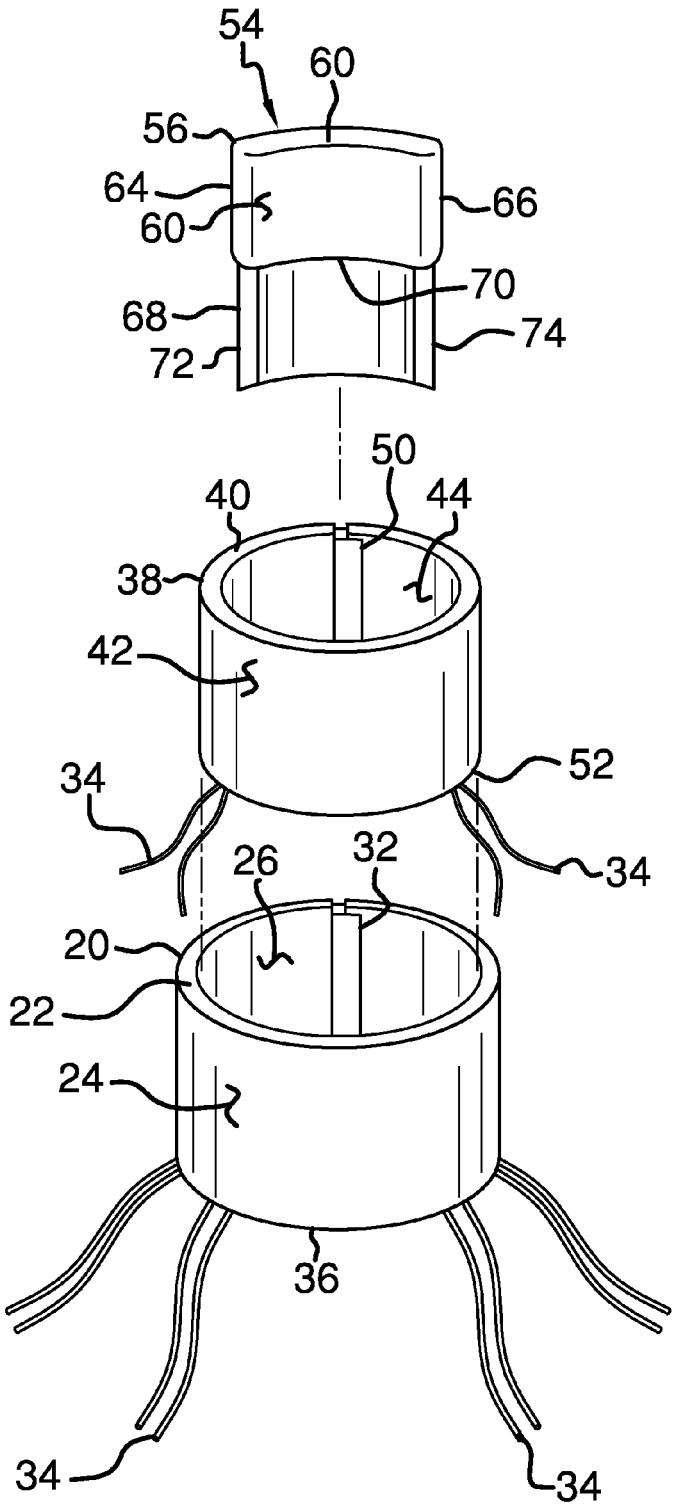
FIG. 2 is a top perspective view of an embodiment of the disclosure.
Figure 3:
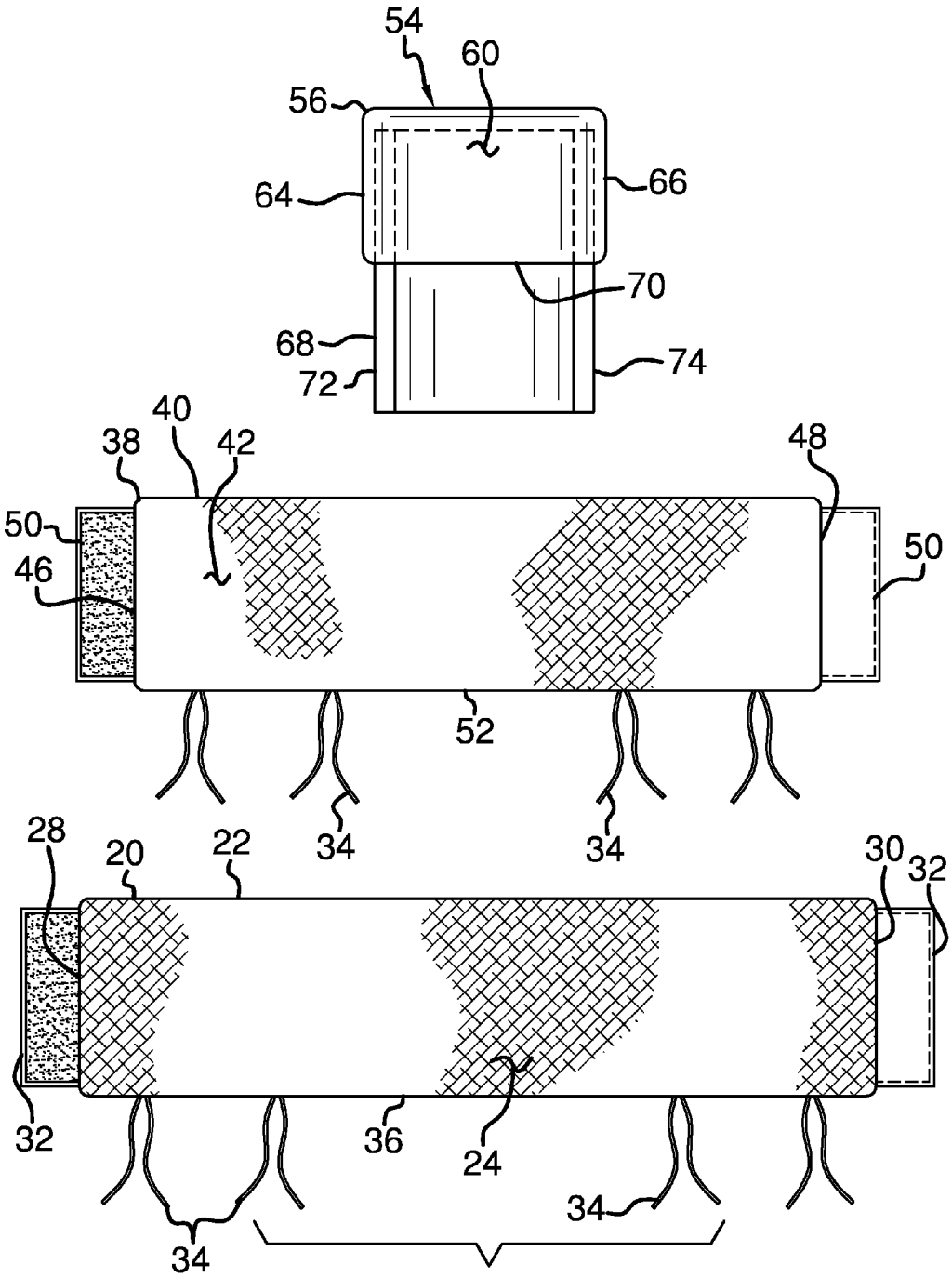
FIG. 3 is a front view of an embodiment of the disclosure.
Figure 4:
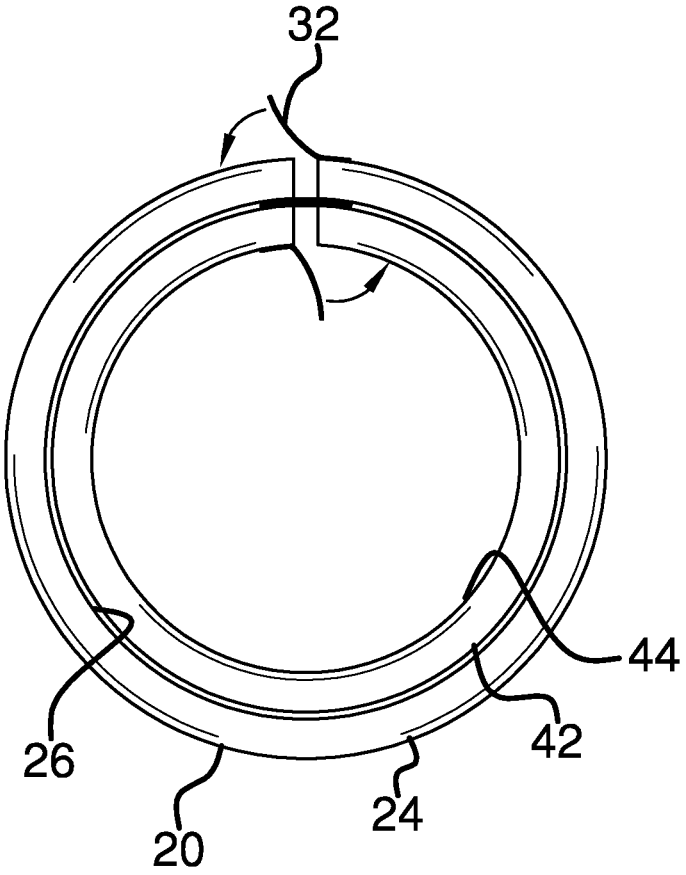
FIG. 4 is a top view of an embodiment of the disclosure.
Figure 5:
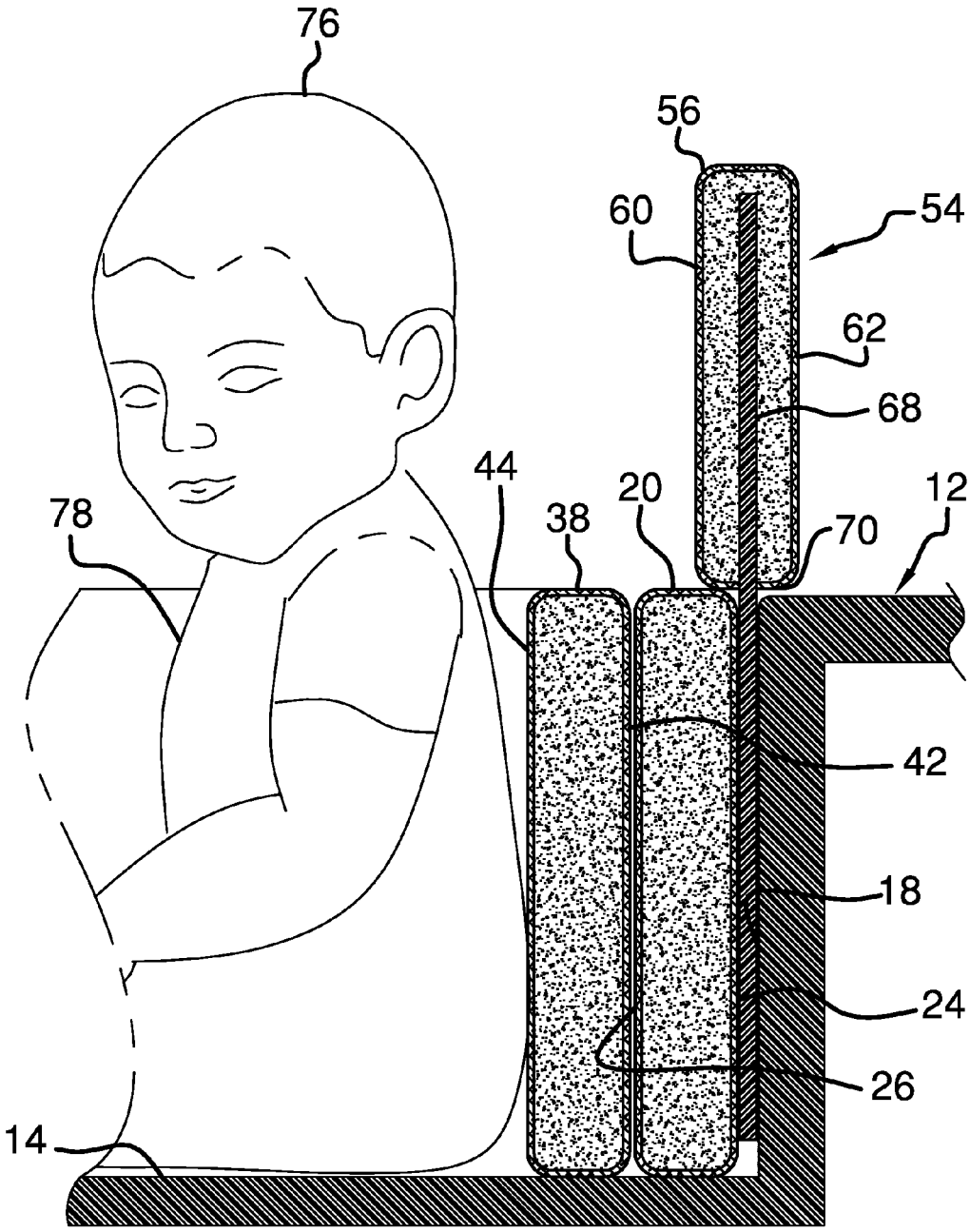
FIG. 5 is a cross sectional view taken along line 5-5 of FIG. 1 of an embodiment of the disclosure.

With reference now to the drawings, and in particular to FIGS. 1 through 5 thereof, a new support device embodying the principles and concepts of an embodiment of the disclosure and generally designated by the reference numeral 10 will be described.

As best illustrated in FIGS. 1 through 5, the bodily support assembly 10 generally comprises a play station 12. The play station 12 is structured to have a seat 14 that may hold an infant 16. The play station 12 is further structured to have a bounding wall 18 surrounding the seat 14. The play station 12 may be an infant play station of any conventional design.

A first support 20 is provided. The first support 20 has an outer edge 22 extending between each of a front surface 24 and a back surface 26 of the first support 20. The first support 20 is elongated between each of a first lateral side 28 and a second lateral side 30 of the outer edge 22 of the first support 20. The first support 20 may be comprised of a resiliently compressible material.

A pair of first couplers 32 is each coupled to and extends laterally away from an associated one of the first 28 and second 30 lateral sides of the outer edge 22 of the first support 20. The first couplers 32 are complementary so the first support 20 is formable into a closed ring. The first couplers 32 may each be hook and loop couplers of any conventional design. The first support 20 is positioned within the play station 12 so the back surface 26 of the first support 20 faces the bounding wall 18 of the play station 12.

A plurality of ties 34 is provided. A first set of ties 34 is coupled to and extends downwardly from a bottom side 36 of the outer edge 22 of the first support 20. The first set of ties 34 are evenly spaced apart and distributed between the first 28 and second 30 lateral sides of the outer edge 22 of the first support 20. The first set of ties 34 may be removably coupled to the play station 12 to retain the first support 20 in the play station 12.

A second support 38 is provided. The second support 38 has an outside edge 40 extending between each of a forward surface 42 and a rearward surface 44 of the second support 38. Additionally, the second support 38 is elongated between a first lateral side 46 and a second lateral side 48 of the outside edge 40 of the second support 38. The second support 38 may be comprised of a resiliently compressible material.

A pair of second couplers 50 is each coupled to and extends laterally away from an associated one of the first 46 and second 48 lateral sides of the outside edge 40 of the second support 38. Each of the second couplers 50 is complementary so the second support 38 is formable into a closed ring. The second couplers 50 may each be hook and loop fasteners of any conventional design.

The second support 38 is positioned within the play station 12 after the first support 20 is positioned within the play station 12. The forward surface 42 of the second support 38 abuts the back surface 26 of the first support 20. The first 20 and second 38 supports may securely hold the infant 16 when the infant 16 is positioned on the seat 14.

The plurality of ties 34 includes a second set of ties 34. The second set of ties 34 are coupled to and extends downwardly from a lower side 52 of the outer edge 40 of the second support 38. The second set of ties 34 are evenly spaced apart and distributed between the first 46 and second 48 lateral sides of the outside edge 40 of the second support 38. The second set of ties 34 may be removably coupled to the play station 12 to retain the second support 38 in the play station 12.

A head rest 54 is provided. The head rest 54 comprises a pad 56. The pad 56 has an outermost edge 58 extending around a frontmost surface 60 of the pad 56. The frontmost 60 surface of the pad 56 is curvilinear between each of a first sidelong side 64 and a second sidelong side 66 of the outermost edge 58 of the pad 56. Additionally, the pad 56 may be comprised of a resiliently compressible material.

A panel 68 is provided. The pad 56 is coupled to the panel 68 so the panel 68 extends downwardly from a bottom side 70 of the outermost edge 58 of the pad 56. The panel 68 may be comprised of a substantially rigid material supporting the pad 56 in an upright position. Each of a first flanking side 72 and a second flanking side 74 of the panel 68 may be comprised of a flexible material. The panel 68 is positioned between the front surface 24 of the first support 20 and the bounding wall 18 of the play station 12. The pad 56 is positioned above the first support 38 so the head rest 54 may support the infant's head 76 when the infant 16 is positioned on the seat 14.

In use, the first 20 and second 38 supports are positioned within the play station 12 prior to placing the infant 16 in the play station 12. The first 20 and second 38 supports wrap around the infant's upper torso 78 when the infant 16 is placed within the play station 12. The head rest 54 prevents the infant's head 76 from tipping rearwardly while the infant 16 is placed in the play station 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bodily support assembly comprising:

a play station configured to contain an infant;

a first support structured to be positioned within said play station, said first support having an outer edge extending between each of a front surface and a back surface of said first support, said first support being elongated between each of a first lateral side and a second lateral side of said outer edge of said first support;

a second support structured to be positioned around the infant, said second support being positioned within said first support such that the infant is securely held within said play station; and a head rest configured to prevent backwards tipping of the infant's head while the infant is positioned within said play station; and a pair of first couplers each coupled to and extending laterally away from an associated one of said first and second lateral sides of said outer edge of said first support.

2. The assembly according to claim 1, further comprising said play station being structured to have a seat configured to support the infant, said play station being further structured to have a bounding wall surrounding said seat.

3. The assembly according to claim 1, further comprising said first couplers being complementary such that said first support is formable into a closed ring.

4. The assembly according to claim 3, further comprising:

said play station having a seat surrounded by a bounding wall of said play station; and said first support being positioned within said play station such that said back surface of said first support abuts said bounding wall of said play station.

5. The assembly according to claim 1, further comprising said second support having an outside edge extending between each of a forward surface and a rearward surface of said second support, said second support being elongated between a first lateral side and a second lateral side of said outside edge of said second support.

6. A bodily support assembly comprising:

a play station configured to contain an infant;

a first support structured to be positioned within said play station;

a second support structured to be positioned around the infant, said second support being positioned within said first support such that the infant is securely held within said play station, said second support having an outside edge extending between each of a forward surface and a rearward surface of said second support, said second support being elongated between a first lateral side and a second lateral side of said outside edge of said second support;

a head rest configured to prevent backwards tipping of the infant's head while the infant is positioned within said play station; and a pair of couplers each coupled to and extending laterally away from an associated one of said first and second lateral sides of said outside edge of said second support.

7. The assembly according to claim 6, further comprising each of said couplers being complementary such that said second support is formable into a closed ring.

8. The assembly according to claim 7, further comprising:

said play station having a seat surrounded by a bounding wall of said play station;

said first support having a back surface; and said second support being positioned within said play station with said first support being positioned within said play station such that said forward surface of said second support abuts said back surface of said first support wherein said first and second supports are configured to securely hold the infant when the infant is positioned on said seat.

9. The assembly according to claim 1, wherein said head rest comprising:

a pad having a bottom edge; and a panel coupled to and positioned behind said pad such that said panel extends downwardly from said bottom edge of said pad.

10. The assembly according to claim 9, further comprising:

said play station having a seat surrounded by a bounding wall of said play station;

said first support being positioned within said play station such that a front surface of said first support abuts said bounding wall of said play station; and said panel being positioned between said front surface of said first support and said bounding wall of said play station such that said pad is positioned above said first support such that said head rest is configured to prevent backwards tipping of the infant's head when the infant is positioned on said seat.

11. A bodily support assembly comprising:

a play station, said play station being structured to have a seat configured to hold an infant, said play station being further structured to have a bounding wall surrounding said seat;

a first support, said first support having an outer edge extending between each of a front surface and a back surface of said first support, said first support being elongated between each of a first lateral side and a second lateral side of said outer edge of said first support;

a pair of first couplers each coupled to and extending laterally away from an associated one of said first and second lateral sides of said outer edge of said first support, said first couplers being complementary such that said first support is formable into a closed ring, said first support being positioned within said play station such that said front surface of said first support faces said bounding wall of said play station;

a second support, said second support having an outside edge extending between each of a forward surface and a rearward surface of said second support, said second support being elongated between a first lateral side and a second lateral side of said outside edge of said second support;

a pair of second couplers each coupled to and extending laterally away from an associated one of said first and second lateral sides of said outside edge of said second support, each of said second couplers being complementary such that said second support is formable into a closed ring;

said second support being positioned within said play station after said first support is positioned within said play station such that said forward surface of said second support abuts said back surface of said first support wherein said first and second supports are configured to securely hold the infant when the infant is positioned on said seat;

a head rest, said head rest comprising;

a pad having a bottom edge;

a panel being coupled to and positioned behind said pad such that said panel extends downwardly from said bottom edge of said pad; and said panel being positioned between said front surface of said first support and said bounding wall of said play station such that said pad is positioned above said first support wherein said head rest is configured to prevent backwards tipping of the infant's head when the infant is positioned on said seat.

* * * * *